United States Patent [19]

Erickson

[11] 4,249,860

[45] Feb. 10, 1981

[54] PUMPING APPARATUS FOR FLUIDS CONTAINING ABRASIVE PARTICULATES

[75] Inventor: John W. Erickson, Huntington Beach, Calif.

[73] Assignee: Kobe, Inc., City of Commerce, Calif.

[21] Appl. No.: 23,210

[22] Filed: Mar. 23, 1979

[51] Int. Cl.[3] ..... F04D 29/06

[52] U.S. Cl. ..... 415/111; 415/121 R; 210/399

[58] Field of Search ..... 415/110, 111, 115, 121 A, 415/168, 170 R, 105, 121 R, 501; 210/398, 399

[56] References Cited

U.S. PATENT DOCUMENTS

| | | | |
|---|---|---|---|
| 1,098,150 | 5/1914 | Haver | 210/398 X |
| 1,348,980 | 8/1920 | Chapman et al. | 415/105 |
| 1,570,285 | 1/1926 | Schleyer | 415/111 X |
| 1,667,992 | 5/1928 | Sherwood et al. | 415/105 |
| 1,999,163 | 4/1935 | Allen | 415/105 |
| 2,156,161 | 4/1939 | Owens | 415/111 |
| 2,161,862 | 6/1939 | Hait | 415/111 |
| 3,487,432 | 12/1969 | Jensen | 415/501 X |
| 3,494,291 | 2/1970 | Carter, Jr. | 415/110 |
| 3,850,550 | 11/1974 | Kaessen | 415/111 X |

*Primary Examiner*—Leonard E. Smith
*Attorney, Agent, or Firm*—William C. Norvell, Jr.

[57] ABSTRACT

A pump is provided which is specifically designed for the pumping of abrasive particulates, such as a pump employed in the bottom of an oil well. Within a cylindrical housing, one or more pumping stages are provided to pressurize the particulate containing fluid to move the fluid axially through the housing and into a centrifugal type particulate separator mounted on the same shaft as that which drives the pumping stages. The separator effects the division of the fluid into two radially adjacent, axially moving fluid streams with the inner stream being relatively free of particulates and the outer stream containing most of the particulates. A second pump operated by the common pump shaft is employed to increase the pressure of the clean fluid stream above that of the pressurized particulate containing stream and conduit means are then provided for supplying portions of the pressurized clean fluid to each of the bearings and seals contained in the pumping stages and to labyrinth type seals employed in a thrust dummy on the shaft which offsets the thrust reaction forces of the pumping stages.

5 Claims, 1 Drawing Figure

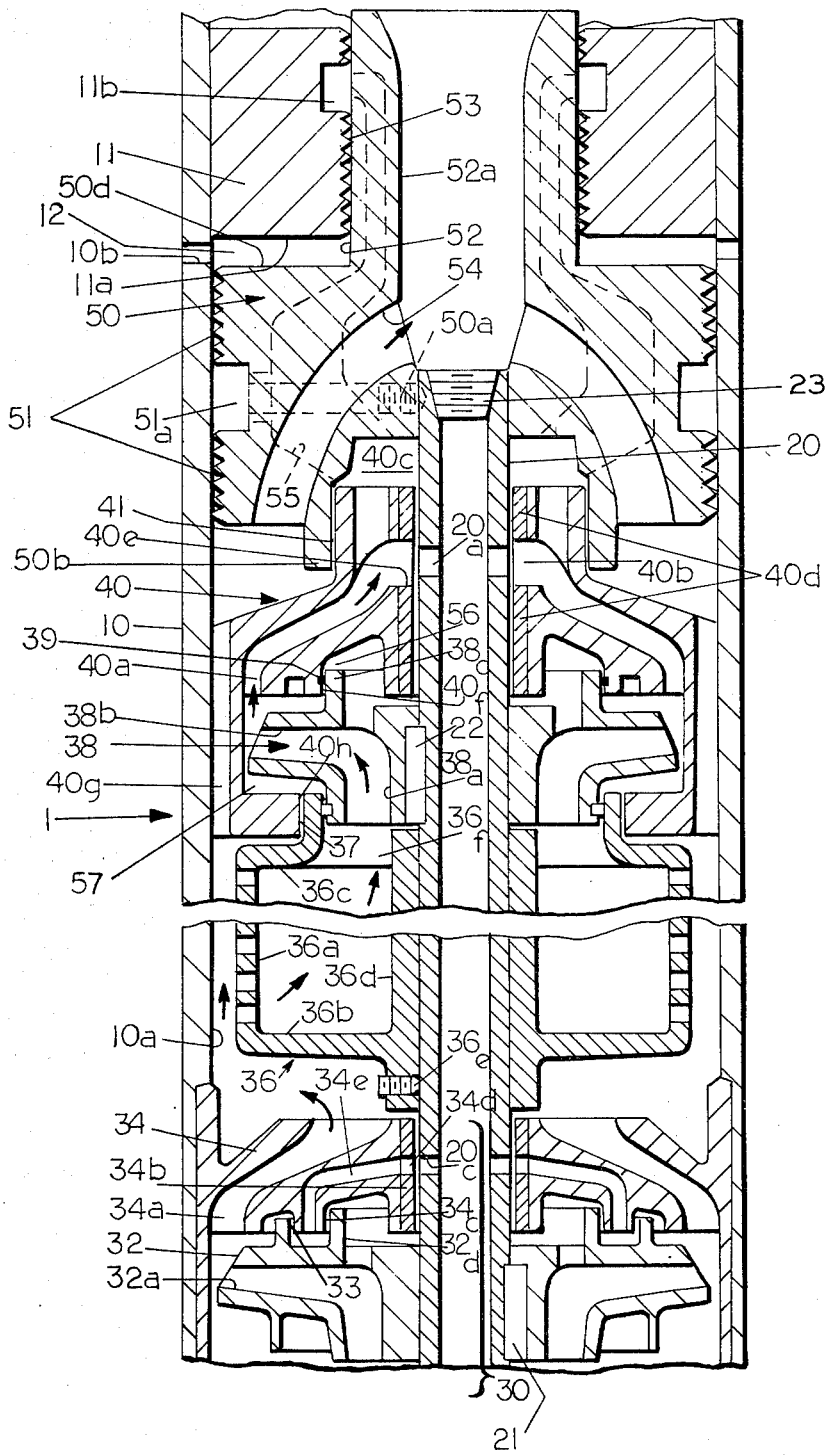
11b
53
11
52a
50d
12
52
10b
54
11a
50
50a
23
51
51a
20
40c
55
41
20a
40e
50b
40b
40d
40
56
10
39
38c
40a
40f
38b
22
38
40h
38a
40g
36f
1
37
57
36c
36a
36d
36b
10a
36e
36
34e
34d
34
20c
34b
34a
34c
32
32d
32a
33
30
21

PUMPING APPARATUS FOR FLUIDS CONTAINING ABRASIVE PARTICULATES

BACKGROUND OF THE INVENTION

1. FIELD OF THE INVENTION

The invention relates to submersible pumps employed in many industrial applications to pressurize fluid containing significant amounts of particulates. Such pumps are often used in the bottom of an oil well wherein the fluid being pumped from the well contains a substantial amount of sand or other particulate matter.

2. DESCRIPTION OF THE PRIOR ART

Submersible pumps heretofore employed in oil wells or other pumping applications involving fluids containing significant quantities of abrasive particulate matter have been plagued with the rapid destruction of the bearing and seal components of the pump by the abrasive action of the particulates contained in the fluid. It is a practical impossibility to effect a complete sealing of each pump bearing and each pump seal from at least exposure at one axial end or the other to the fluid containing the abrasive particulate matter. Accordingly, the prior art has had to resort to the use of exotic materials and expensive bearing and seal constructions in order to minimize the abrasive effects of such particulates.

Such submersible pumps must necessarily be of restricted diameter in order to permit them to be inserted within the oil well casing. Hence, a further problem has been encountered in providing means for neutralizing the thrust reaction force produced by the operation of the pumping stages of the pumping apparatus.

SUMMARY OF THE INVENTION

This invention contemplates the combination within a single pump housing of one or more pumping stages, a centrifugal type particulate separator, and a thrust dummy, all of which are driven by a common shaft. The shaft may be driven by a conventional submersible electric or fluid motor.

Each of the bearings and fluid seals utilized in the apparatus of this invention is of the axially elongated type and is supplied near their respective axial central or end portions with pressurized relatively clean fluid which in turn is derived from the centrifugal separator. In this manner, the abrasive effects of the particulates contained in the fluid to be pumped are minimized because such abrasives are effectively prevented from entering any of the bearings or seals employed in the apparatus. In addition, the thrust dummy is subjected to a pressure differential which generates a net reaction force on the shaft substantially equal and opposite to the thrust reaction force produced by the pumping stages. The throttling surfaces of the thrust dummy are also supplied with the relatively clean fluid.

Accordingly, it is an object of this invention to provide an improved pumping apparatus for fluids containing abrasive particulates.

More particularly, it is an object of this invention to provide an improved submersible pumping apparatus capable of being positioned in the bottom of an oil well casing to effect the pumping of fluids containing significant amounts of sand from such oil well, the construction and method of operation of the pump being such that the pressurized fluid containing abrasives is effectively prevented from entering the various bearings and seals employed in the pumping and related apparatus, thereby greatly extending the life of the apparatus.

BRIEF DESCRIPTION OF THE SINGLE DRAWING

The single FIGURE on the drawing represents a schematic, vertical cross-sectional view of a pumping apparatus embodying this invention.

DESCRIPTION OF THE PREFERRED EMBODIMENTS

The numeral 1 schematically represents a completely assembled oil well pumping apparatus embodying this invention. Such apparatus includes a hollow cylindrical housing 10 which surrounds an axially concentric, hollow shaft 20. At the lower end of housing 10 (not shown), a suitable submersible electric or fluid motor is mounted and provides rotational power to the shaft 20; however, the construction of such motor forms no part of this invention and hence it has not been shown. The bottom end of housing 10 is also provided with perforations (not shown) to permit the flow into such housing of the fluid to be pumped. In the case of an oil well, this fluid generally contains a significant amount of abrasive particles such as sand.

Depending on the depth of the well, one or more stages of centrifugal type pumps 30 are mounted within housing 10 and have their impeller portions 32 driven by the shaft 20 through a key 21. Fluid is discharged from the outlet opening **32*a* of the impeller 32 with a high rotational velocity and is received within an annular diffusion chamber 34*a* of a stationary bowl or diffusion member 34 which is suitably secured to the inner wall of housing 10. A journal type bearing 34*b* is provided on the inner portions of the diffusion member 34 to constitute one of a plurality of axially spaced bearings supporting the power shaft 20 for rotation within the housing 10. By virtue of the well known action of the diffusion chamber 34*a*, the kinetic energy of the particulate containing fluid is converted into a pressure head and the pressurized fluid flows into a centrifugal type particulate separator unit 36. The separator 36 comprises a cylindrical perforated wall 36*a* supported by two axially spaced radial flanges 36*b* and 36*c* formed on a central annular core 36*d* which is secured to power shaft 20 by a set screw 36*e*. Since the fluid enters the chamber in which the separator 36 is rotating with a significant rotational velocity, and is engaged by the rotating separator 36, it is caused by such centrifugal action to divide into two radially adjacent, axially moving fluid streams. The outermost stream, which passes adjacent the interior wall 10*a* of the housing 10 contains most of the particulates while the inner stream passes through the perforated cylindrical wall 36*a*** and is relatively free of particulates and hence may be considered a clean fluid.

The clean portion of the fluid is discharged axially through an annular opening **36*f* and passes into the inlet opening 38*a* of a centrifugal pump impeller 38 which is keyed to power shaft 20 by key 22. A stationary diffusion member 40 of conventional configuration receives the high velocity clean fluid discharged at 38*b* from the impeller 38 in its annular inlet passage 40*a* and effects the conversion of the kinetic energy of the clean fluid into a pressure head. It is therefore apparent that the pressure of the clean fluid emerging from the discharge conduit 40*b* of the stationary diffusion member 40 and into an annular chamber 40*c* is significantly higher than the pressure of the particulate containing fluid which bypasses the impeller 38 by passing through an annular series of passages 40***g* provided in the peripheral portion of the stationary diffuser member 40. A journal type bearing 40*d* is mounted on the inner portion of the diffuser member 40 to provide additional bearing support for the power shaft 20.

As is well known to those skilled in the art, each of the centrifugal type pumping impellers 32 and 38 inherently produce a downwardly directed thrust reaction force and such force would impose a substantial thrust load on the bearings in the driving motor for shaft 20. To offset and balance such thrust force, a thrust dummy unit 50 is provided within housing 10, comprising a generally cylindrical mass secured to the end of power shaft 20 by a set screw 50*a*. The outer cylindrical wall of mass 50 is disposed in close proximity to the inner wall 10*a* of housing 10 and a conventional labyrinth seal 51 is provided to minimize the passage of fluid therebetween. The upper portion of mass 50 is of reduced diameter as indicated at 52 and an annular insert 11 is mounted within the housing 10 to provide an internal surface in close proximity to the cylindrical external surface of reduced diameter portion 52. A labyrinth type seal 53 is provided to prevent the passage of fluid between such cooperating surfaces. The mass 50 is further provided with a generally axially extending fluid passage 54 which provides the discharge path for the particulate containing stream of fluid being pumped. Passage 54 communicates with the bore 52*a* of the reduced diameter portion 52 of the thrust dummy mass 50 which in turn connects with a suitable tubing string (not shown) extending to the top of the well.

A small annular chamber 12 is defined between the end wall 50*d* of the large diameter portion of mass 50 and the axially adjacent wall 11*a* of the annular insert 11, and is connected to a source of pressure by one or more radial holes 10*b* provided in the wall of housing 10. It is therefore apparent that the thrust dummy 50 is subjected to an upward differential pressure force represented by the difference between the pressure of the pressurized particulate containing fluid and pressure applied to the annular area of the chamber 12. This chamber area is proportioned so that the resulting net force will be substantially equal and opposite to the thrust reaction force of the various centrifugal pumps 30 and 38 hence the thrust reaction forces of the pumps on the shaft 20 are essentially neutralized.

A number of fluid passages are provided for diverting portions of the pressurized clean fluid from the annular outlet chamber 40*c* to each of the bearings and seals employed in the apparatus. For example, a passage 55 is provided in the thrust dummy mass 50 which communicates with an annular opening 51*a* in the medial portions of the labyrinth seal 51 and also with an annular chamber 11*b* provided in the annular insert 11 near the medial portion of the labyrinth seal 53.

The annular sealing area 41 between discharge end of the diffuser 40 and an annular flange 50*b* on the bottom of the mass 50 is supplied with pressurized clean fluid by direct communication with chamber 40*c*.

An opening 20*a* is provided in the wall of the hollow power shaft 20 to permit a portion of the pressurized clean fluid to flow therein through an annular opening 40*e* in the journal bearing 40*d*. Thus, the clean fluid is applied to a medial portion of the journal bearing 40*d*, and since the pressure of such clean fluid exceeds that of the particulate containing fluid, the particulate containing fluid is effectively prevented from entering the journal bearing. Similarly, an annular passage 56 provides a thrust balance for impeller 38. Similarly, an annular passage 57 provides clean fluid to the annular sealing area 37 between the outlet of the inner chamber of the centrifugal separator 36 and the inwardly projecting wall 40*h* of the diffuser 40.

A similar annular sealing area 33 is provided between an annular extension 32*d* formed on the centrifugal pump impeller 32 and an annular projection 34*c* formed on the adjacent side of the stationary diffusion member 34. This seal, as well as the bearing 34*b* is supplied with a flow of pressurized clean fluid from the hollow interior of power shaft 20 through a wall opening 20*c* in such shaft, an opening 34*d* in the bearing 34*b* and a conduit 34*e* formed in the stationary diffusion member 34. The hollow shaft 20 is, of course, provided with a plug 23 at its top and bottom ends in order to avoid loss of the pressurized clean fluid introduced into its interior.

From the foregoing description it is readily apparent that this invention provides a flow of pressurized relatively clean fluid to the central portion of every journal bearing and the center or end of every seal utilized in the described pumping apparatus. Due to the fact that the absolute pressure of the pressurized clean fluid is in excess of the pressurized particulate containing fluid, the effect of such introduction will be to maintain an outward flow of clean fluid from each axial end of every bearing and seal exposed to particulate containing fluid and thus effectively prevent any of the particulate containing fluid from entering the relatively close clearances provided in such bearings and seals. The clean fluid exiting from such bearings and seals merely joins the pressurized particulate containing fluid and is pumped with it out of the well.

Since no particulate containing fluid can work its way into the close clearances provided in the various bearings and seals, it is obvious that the life of such bearings and seals is substantially increased by utilization of the method and apparatus of this invention.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for pumping fluid containing abrasive particulates comprising: a generally cylindrical housing; a power driven shaft; a plurality of bearing means in said housing for journaling said shaft therein; said housing having inlet means for a particulate containing fluid at one axial end thereof; a first pump disposed in said housing adjacent said fluid inlet means and arranged to pressurize the particulate containing fluid to move said fluid axially through said housing; a centrifugal type particulate separating means mounted on said shaft to receive the pressurized particulate containing fluid from said first pump and operating to divide the said fluid into two axially moving fluid streams, one of the fluid streams being clean and relatively free of sand and the other fluid stream containing most of the particulate; a second pump operated by said shaft to increase the pressure of the clean fluid stream above that of the pressurized particulate containing fluid stream; conduit means for supplying said pressurized clean fluid to each of said bearings to thereby prevent the entrance of particulate containing fluid into said bearings, each of said first and second pumps having axially extending fluid sealing means mounted between the stationary and rotary portions of the pump; second conduit means for supplying a portion of said pressurized clean fluid to each of said fluid sealing means; a cylindrical body secured to said shaft, said cylindrical body having a pair of axially opposed faces, one of said faces being exposed to the stream of particulate containing fluid; conduit means for exposing the other of said faces to a source of pressure, the difference in pressures imposed on said faces and the respective areas of said faces being proportioned to generate a net thrust force on said shaft approximately equal and opposite to the thrust force generated by said first and second pumps; an axially extending, labyrinth seal disposed between the peripheral portions of said cylindrical body and said housing; and third conduit means for supplying a portion of said pressurized clean fluid to the central portion of said labyrinth seal to thereby prevent the entrance of particulate containing fluid into said seal.

2. An apparatus for pumping fluid containing abrasive particulates comprising: a generally cylindrical housing; a power driven shaft; a plurality of bearing means in said housing for journaling said shaft therein; said housing having inlet means for a particulate containing fluid at one axial end thereof; a first pump disposed in said housing adjacent said fluid inlet means and arranged to pressurize the particulate containing fluid to move said fluid axially through said housing; a centrifugal type particulate separating means mounted on said shaft to receive the pressurized particulate containing fluid from said first pump and operating to divide the said fluid into two axially moving fluid streams, one of the fluid streams being clean and relatively free of sand and the other fluid stream containing most of the particulate; a second pump operated by said shaft to increase the pressure of the clean fluid stream above that of the pressurized particulate containing fluid stream; conduit means for supplying said pressurized clean fluid to each of said bearings to thereby prevent the entrance of particulate containing fluid into said bearings; a cylindrical body secured to said shaft, said cylindrical body having a pair of axially opposed faces, one of said faces being exposed to the stream of particulate containing fluid; conduit means for exposing the other of said faces to a source of pressure, the difference in pressures imposed on said faces and the respective areas of said faces being proportioned to generate a net thrust force on said shaft approximately equal and opposite to the thrust forces generated by said first and second pumps; and axially extending, labyrinth seal disposed between the peripheral portions of said cylindrical body and said housing; and second conduit means for supplying a portion of said pressurized clean fluid to the central portion of said labyrinth seal to thereby prevent the entrance of particulate containing fluid into said seal.

3. The apparatus as defined in claims 1 or 2 wherein said centrifugal type particulate separating means comprises: a perforated cylindrical wall mounted between two axially spaced, radially enlarged flanges secured to said shaft, thereby dividing the space between said shaft and the interior wall of said housing into two annular passageways, respectively inside and outside of said perforated cylindrical wall, whereby the fluid stream passing through said perforated cylindrical wall is relatively clean and free of particulates and the fluid stream passing exteriorly of said wall contains most of the particulates.

4. The apparatus as defined in claims 1 or 2 wherein said power driven shaft is hollow and the hollow portion forms part of said conduit means for supplying pressurized clean fluid to said bearings.

5. An apparatus for pumping fluids containing abrasive particulates comprising: a generally cylindrical housing; a power driven shaft; a plurality of bearing means in said housing for journaling said shaft in an axially concentric relationship, said housing having inlet means for a particulate containing fluid at one axial end thereof; a first pump disposed in said housing adjacent said fluid inlet means and having an impeller secured to said shaft and arranged to impart rotational velocity to incoming fluid; a stationary diffusion member secured to said housing and having an expanding area conduit receiving the rotating sandy fluid discharged by said impeller and converting the energy thereof to a pressure head, whereby said pump generates an axial thrust force; a centrifugal type particulate separating means mounted on said shaft to receive the pressurized fluid from said diffusion member and operating to divide the fluid into two axially moving fluid streams, one of the fluid streams being clean and relatively free of particulates and the other fluid stream containing most of the particulates; a second pump operated by said shaft to increase the pressure of the clean fluid stream above that of the pressurized particulate containing fluid stream; a thrust reaction mass secured to said shaft adjacent the outlet of said particulate separating means and having two axially spaced, opposed faces, one of said faces being exposed to the pressurized particulate containing stream to generate a force thereon opposite to the pump thrust force; means for exposing the other said face to pressure, the areas of said faces being respectively proportioned to substantially balance said pump thrust force; axially extending, labyrinth type fluid seals disposed between said rotating mass and the adjacent housing wall; a first fluid conduit means defined in said mass for directing the pressurized particulate containing fluid to a discharge opening; and a second fluid conduit means defined in said mass for directing said clean fluid stream to a medial portion of said labyrinth type seals to prevent particulate conveying fluid from entering such seals.

* * * * *